US006371385B1

(12) United States Patent
Schiller et al.

(10) Patent No.: US 6,371,385 B1
(45) Date of Patent: Apr. 16, 2002

(54) PORTABLE SPRAYING DEVICE

(75) Inventors: Steven E. Schiller, Kenosha; Christopher F. Lang, Racine; James H. Lohr, Union Grove; Curtis H. Hubmann, Racine, all of WI (US)

(73) Assignee: S. C. Johnson Commercial Markets, Inc., Sturtevant, WI (US)

( * ) Notice: Subject to any disclaimer, the term of this patent is extended or adjusted under 35 U.S.C. 154(b) by 0 days.

(21) Appl. No.: 09/615,367

(22) Filed: Jul. 13, 2000

(51) Int. Cl.[7] ..... A62C 5/02

(52) U.S. Cl. ..... 239/310; 239/315; 239/316; 239/375; 239/327; 239/354; 239/525; 239/153; 222/173

(58) Field of Search ..... 239/310, 315, 239/316, 375, 378, 304, 307, 327, 344, 354, 308, 152, 153, 525, 526; 222/173, 397; 294/27.1, 74

(56) References Cited

U.S. PATENT DOCUMENTS

| | | | | | |
|---|---|---|---|---|---|
| 2,153,240 | A | * | 4/1939 | Dailey et al. | 239/310 |
| 2,887,272 | A | * | 5/1959 | Rosenthal | 239/310 |
| 3,920,189 | A | * | 11/1975 | Maggiacomo et al. | 239/526 |
| 4,238,074 | A | * | 12/1980 | Coons | 239/310 |
| 4,266,693 | A | * | 5/1981 | Pfeiffer | 222/173 |
| 4,336,899 | A | * | 6/1982 | Price, II | 294/74 |
| 5,836,364 | A | * | 11/1998 | Burton | 222/397 |

* cited by examiner

*Primary Examiner*—David A. Scherbel
*Assistant Examiner*—Dinh Q. Nguyen
(74) *Attorney, Agent, or Firm*—Neil E. Hamilton; Warren R. Bovee; Renee J. Rymarz

(57) ABSTRACT

A portable sprayer device which affords protection for the liquid concentrate container. A versatile spraying capability is also provided as well as an apparatus producing a vacuum function, an air gap and a spill-proof bottle feature. The sprayer device is particularly suited for dispensing cleaning, germicidal, sanitizing, insecticidal, deodorant materials and any other similar chemical concentrate.

9 Claims, 9 Drawing Sheets

PORTABLE SPRAYING DEVICE

CROSS-REFERENCE TO RELATED APPLICATIONS

NONE

STATEMENT REGARDING FEDERALLY SPONSORED RESEARCH OR DEVELOPMENT

NONE

BACKGROUND OF THE INVENTION

Technical Field

This invention relates to a portable sprayer device. More particularly, it relates to a portable sprayer device having a frame member for supporting and protecting a chemical concentrate container.

A portable dispenser device which can provide accurate dilutions of chemical concentrates as well as spray them is available as the J-FILL Portable™ device from Johnson Wax Professional in Sturtevant, Wisconsin. While this device does perform with a high degree of efficiency, it does not afford a support or protection for the chemical concentrate container. Neither does it provide a hose attachment for spraying.

When employing portable dispenser devices, there is likelihood that the container for the chemical concentrate can inadvertently strike another object such as shelving or a doorway. This could damage the container causing it to leak. It should also be recognized that after prolonged usage, the operator may become fatigued and the operator may want to place the container on a supporting surface such as a floor, but inadvertently do so in a forceful manner. This also could damage the container.

It is also desirable that the portable dispenser device have a hose attachment so as to be more versatile in its spraying capability.

Thus, it can be seen that there is a need for an improved portable dispenser device which affords protection for the container as well as increased spraying capability.

The objects of the invention therefore are:

a. Providing an improved portable sprayer device.

b. Providing a portable sprayer device, which affords protection for the liquid concentrate container.

c. Providing a portable sprayer device, which affords a versatile spraying capability.

d. Providing a portable sprayer device of the foregoing type, which has an apparatus producing a vacuum function and also contains an air gap.

e. Providing a portable sprayer device of the foregoing type, which has a spillproof bottle feature.

SUMMARY OF THE INVENTION

The foregoing objects are accomplished and the shortcomings of the prior art are overcome by the portable sprayer device of this invention which includes a frame member having top, side and bottom portions. The bottom portion is defined by a floor member and a side protective portion, the floor member and side protective portion are constructed and arranged to receive a container on the inside of the side protective portion.

A fluid control valve has a fluid inlet connected to the top portion of the frame member and an eductor is connected to a side portion, the eductor and fluid control valve being in fluid communication. A fluid intake line is in fluid communication with the eductor and a container cap member. A hose member is in fluid communication with the eductor.

In one aspect, the side protective portion is provided by a continuous, uninterrupted wall and the floor member is provided by a strap.

In one embodiment, a fluid container is positioned in the bottom portion and inside the protective portion and the container is supported by the floor member.

In another embodiment the container has a spill proof plug.

In a preferred embodiment, the container has a spill proof plug and the cap member includes a plunger portion for activating the spill proof plug.

In another preferred embodiment, the eductor is back flow tolerant.

DESCRIPTION OF THE PREFERRED EMBODIMENTS

Figure 1:
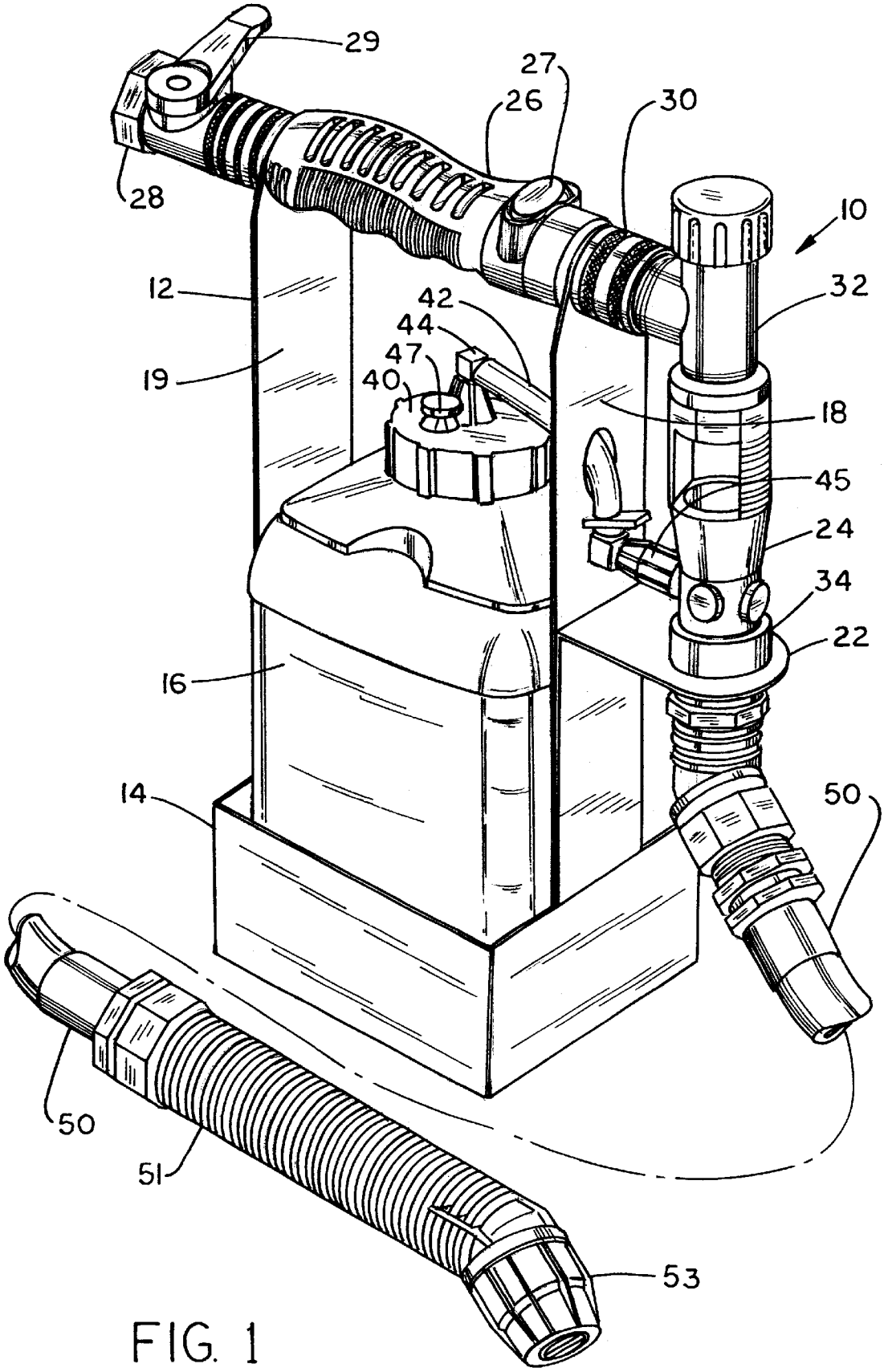
FIG. 1 is a perspective view of the sprayer device of this invention.
Figure 2:
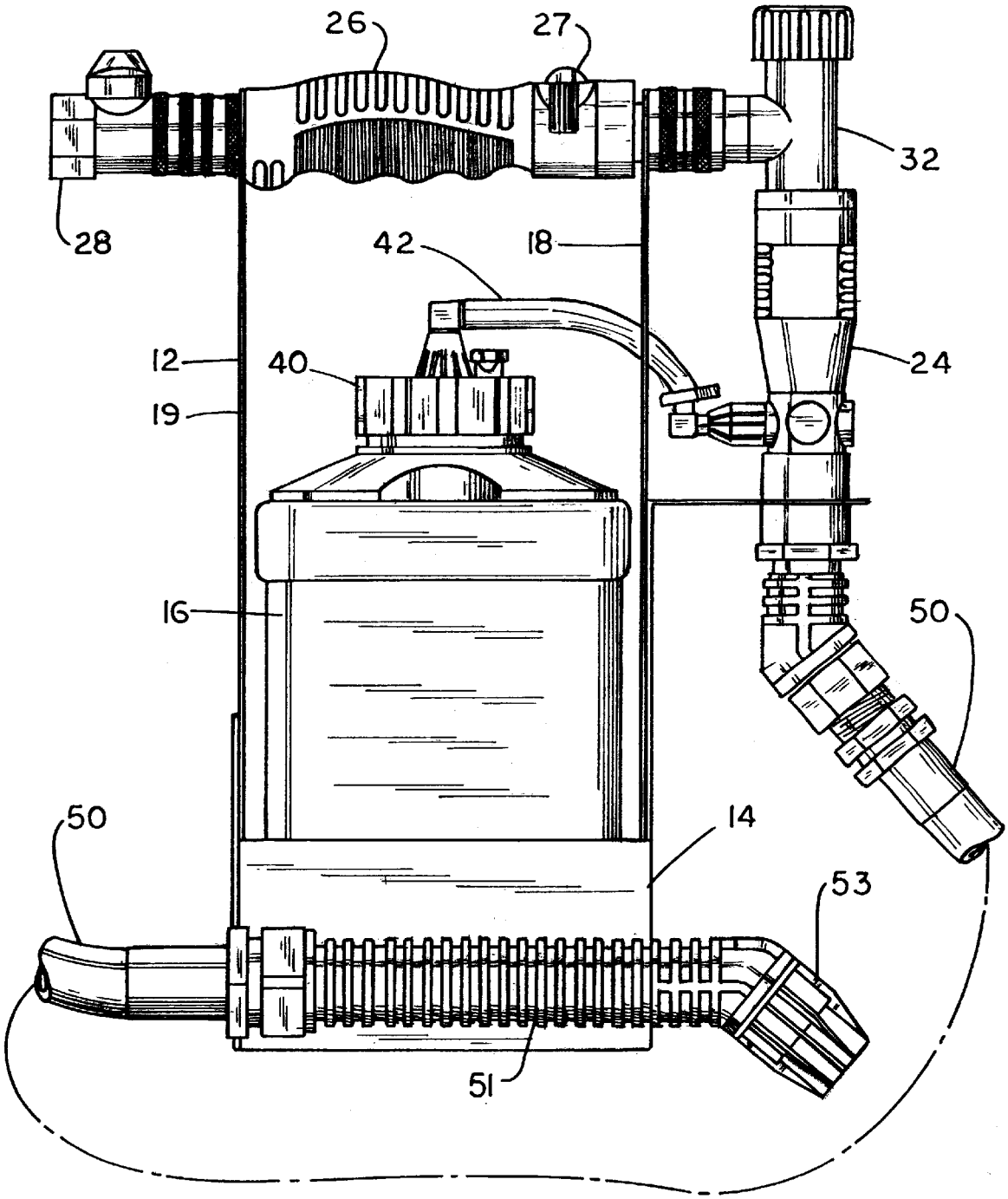
FIG. 2 is front view thereof.
Figure 3:
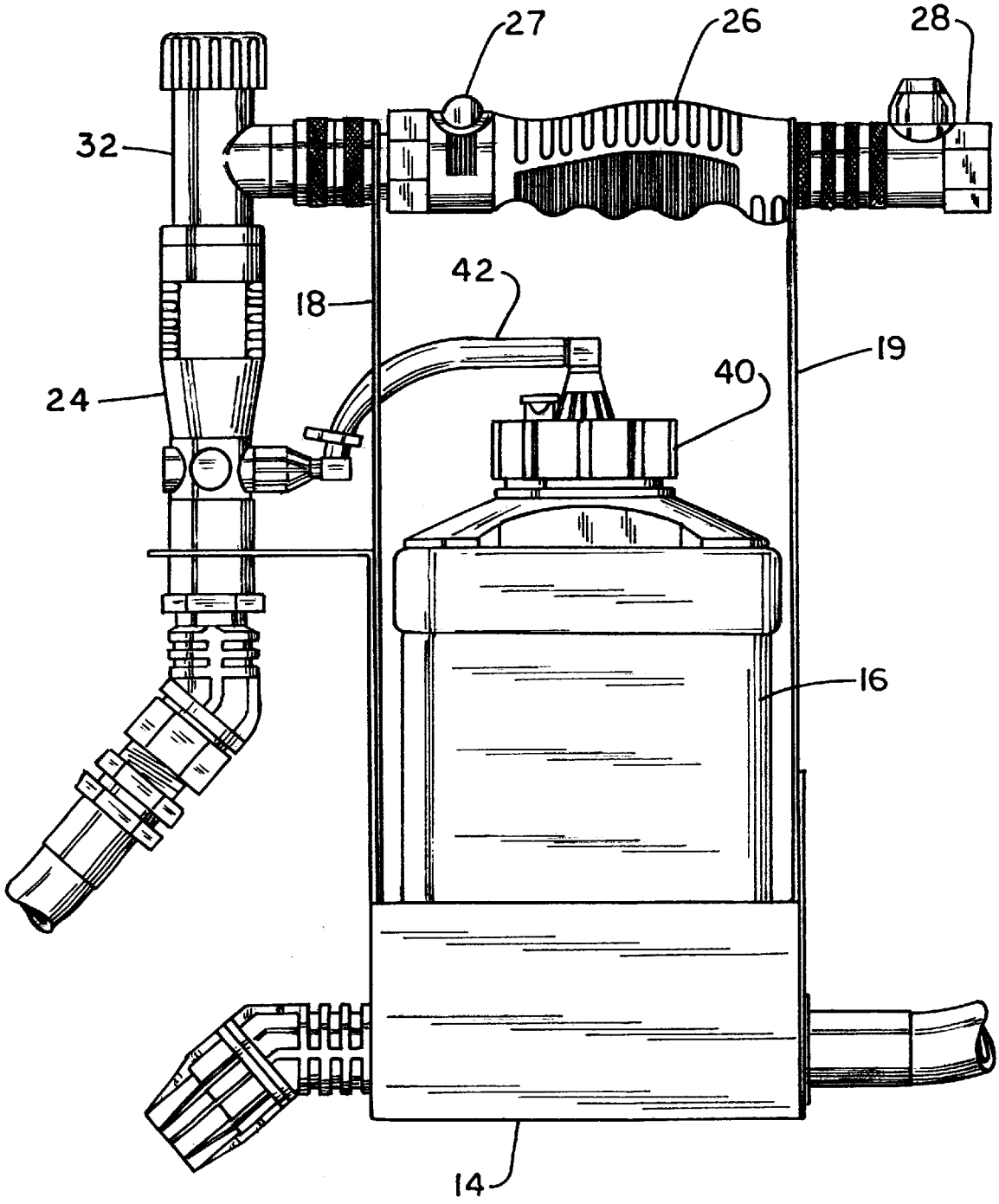
FIG. 3 is a back view thereof.
Figure 4:
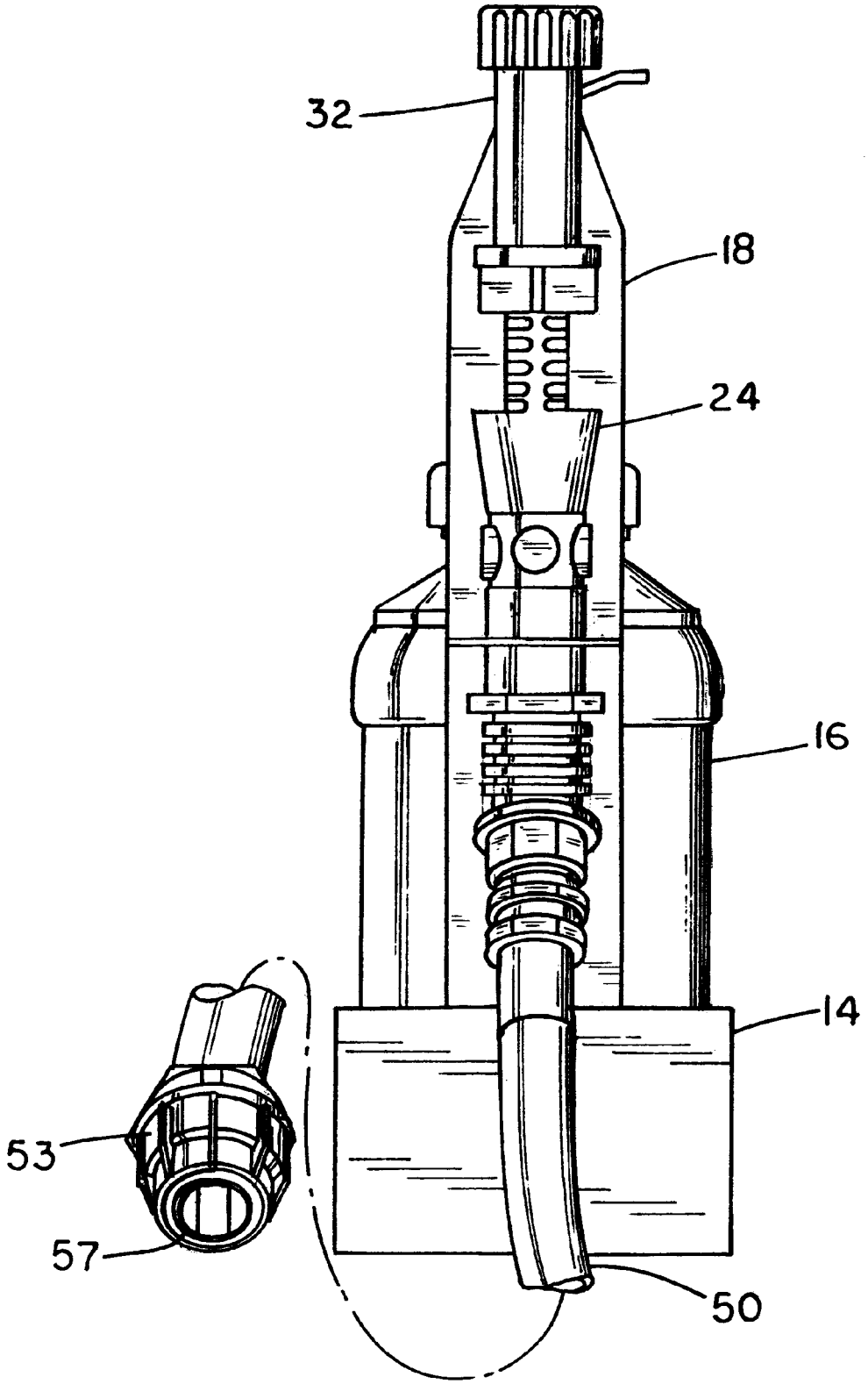
FIG. 4 is a right side view thereof.
Figure 5:
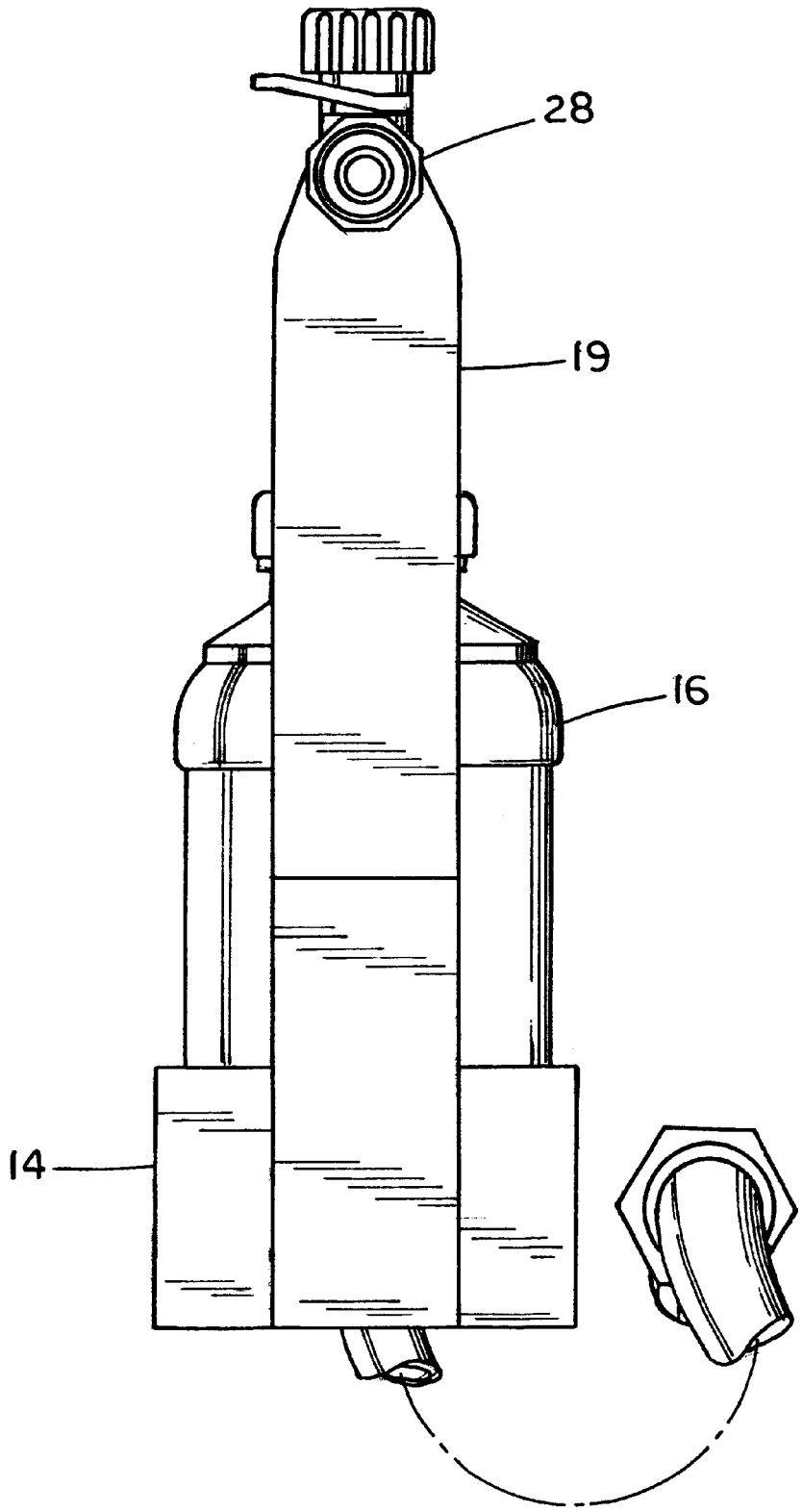
FIG. 5 is a left side view thereof.
Figure 6:
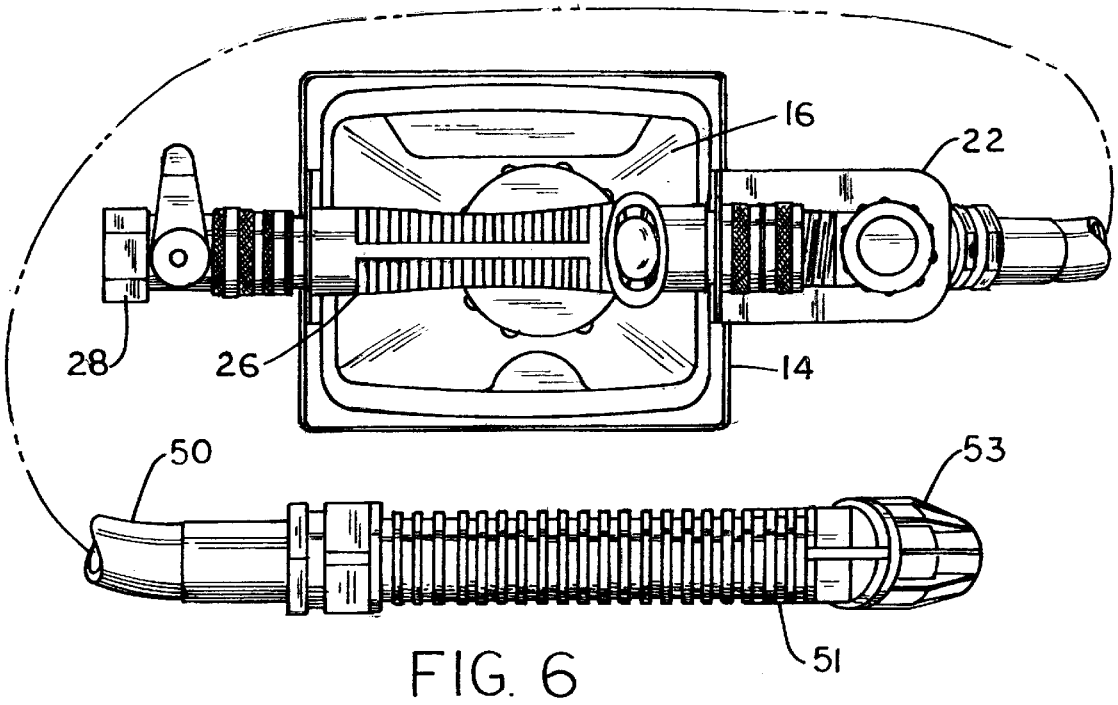
FIG. 6 is a top view thereof.

As shown in FIGS. 1–7, the portable sprayer device generally 10 includes a frame member 12 having a bottom portion 14 for supporting a container 16 of chemical concentrate. The frame member 12 includes two side portions 18 and 19 with a support flange 22 extending from side portion 18 for supporting an eductor 24. The preferred eductor 24 is described in U.S. Pat. No. 5,927,338, which teachings are incorporated herein by reference.

Figure 9:
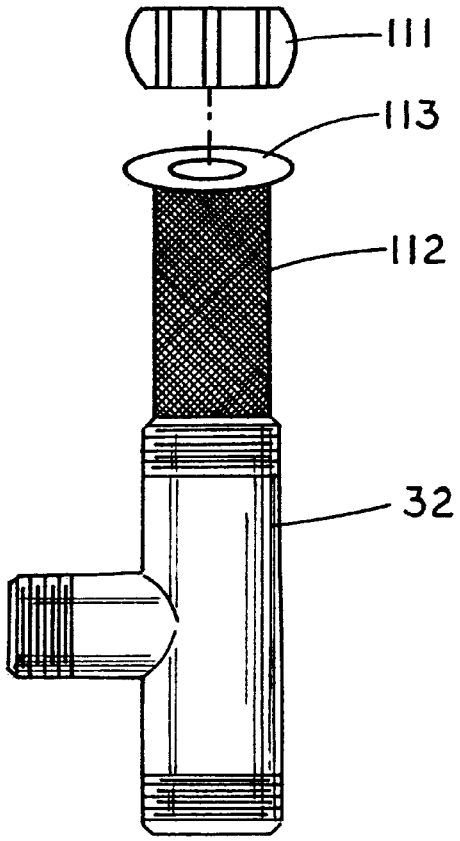
FIG. 9 is an exploded side view of the filter chamber and filter.

A valve member 26 is supported by openings (not shown) through the side portions 18 and 19 at the top thereof. Valve member 26 has a handle portion 25 and an on/off valve portion 27. A preferred valve member 26 is the Shower Torch available from Liberty Home Products, Inc., Company. A hose connector 28 with gate valve 29 is connected to valve member 26 at one end. At the opposite end a connector 30 connects the valve member 26 to a filter chamber 32, which connects with a part of eductor 24. A combined connector and support 34 supports eductor 24 on support flange 22 and connects the eductor 24 to the hose 50. As shown in FIG. 9 the filter chamber 32 generally includes a cap 111 which when opened exposes a filter flange 113 to which is connected a filter 112, which is preferable made from a fine wire mesh, is attached to said filter flange 113.

A cap member 40 is threadably engaged on container 16, the cap member 40 being connected to tube 42 by the connection 44 and the tube 42 placed in fluid communication with the eductor 24 by the connection 45. An air vent 47 with a check valve (not shown) extends though cap member 40.

As seen in FIGS. 1, 2, 6 and 7, the flexible hose 50 includes a rigid section 51 and an angled nozzle 53. This flexible hose 50 affords versatility in spraying while the rigid section 51 gives the user a comfortable grip and can further act as a insulator when used with hot or cold solutions.

Figure 8:
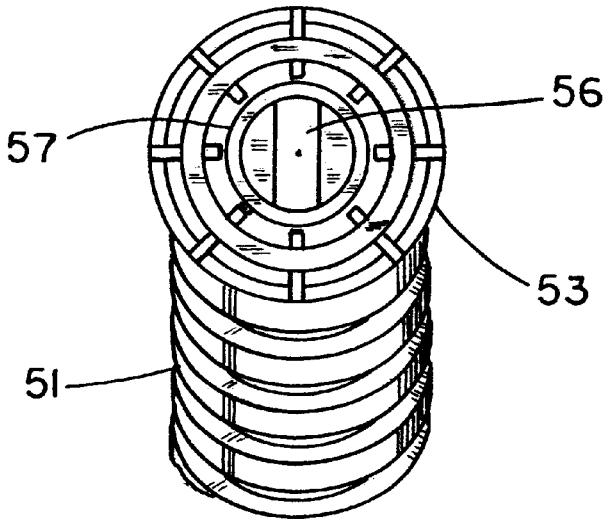
FIG. 8 is an enlarged end view of the nozzle for a hose employed with the sprayer device.

Referring to FIG. 8, it is seen that the nozzle 53 includes an annular member 57 which directs flow though aperture 56. Although eductor 24 is back flow tolerant, the annular member 57 affords a more direct and unobstructed flow thus allowing for a greater height differential between the nozzle 53 and the eductor 24.

Figure 7:
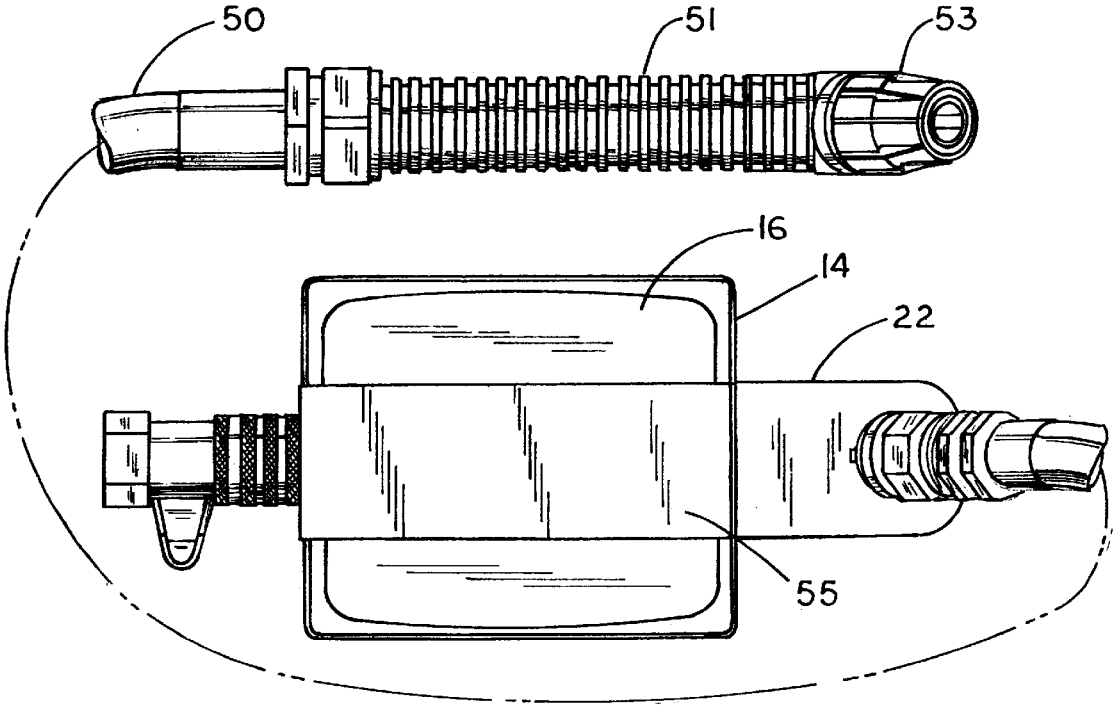
FIG. 7 is a bottom view thereof.

Referring to FIG. 7, a strap 55 extends across the bottom portion 14. This is for the purpose of supporting container 16 in the bottom portion 14. In a preferred embodiment, bottom portion 14 is composed of an impact resistant plastic with side portions 18 and 19 composed of steel.

Figure 10:
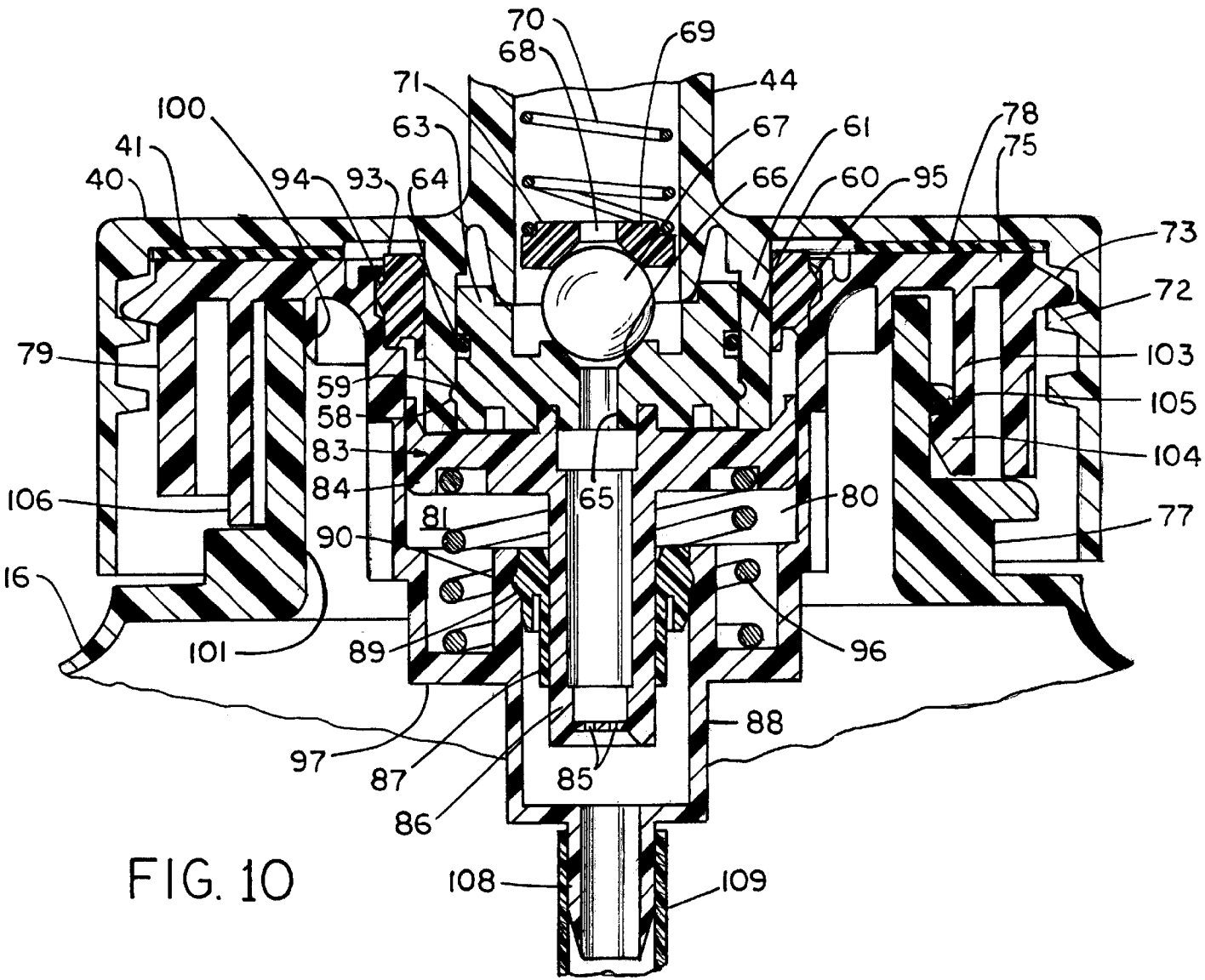
FIG. 10 is a cross-sectional view of a cap member engaging a plug on a container of chemical concentrate.
Figure 11:
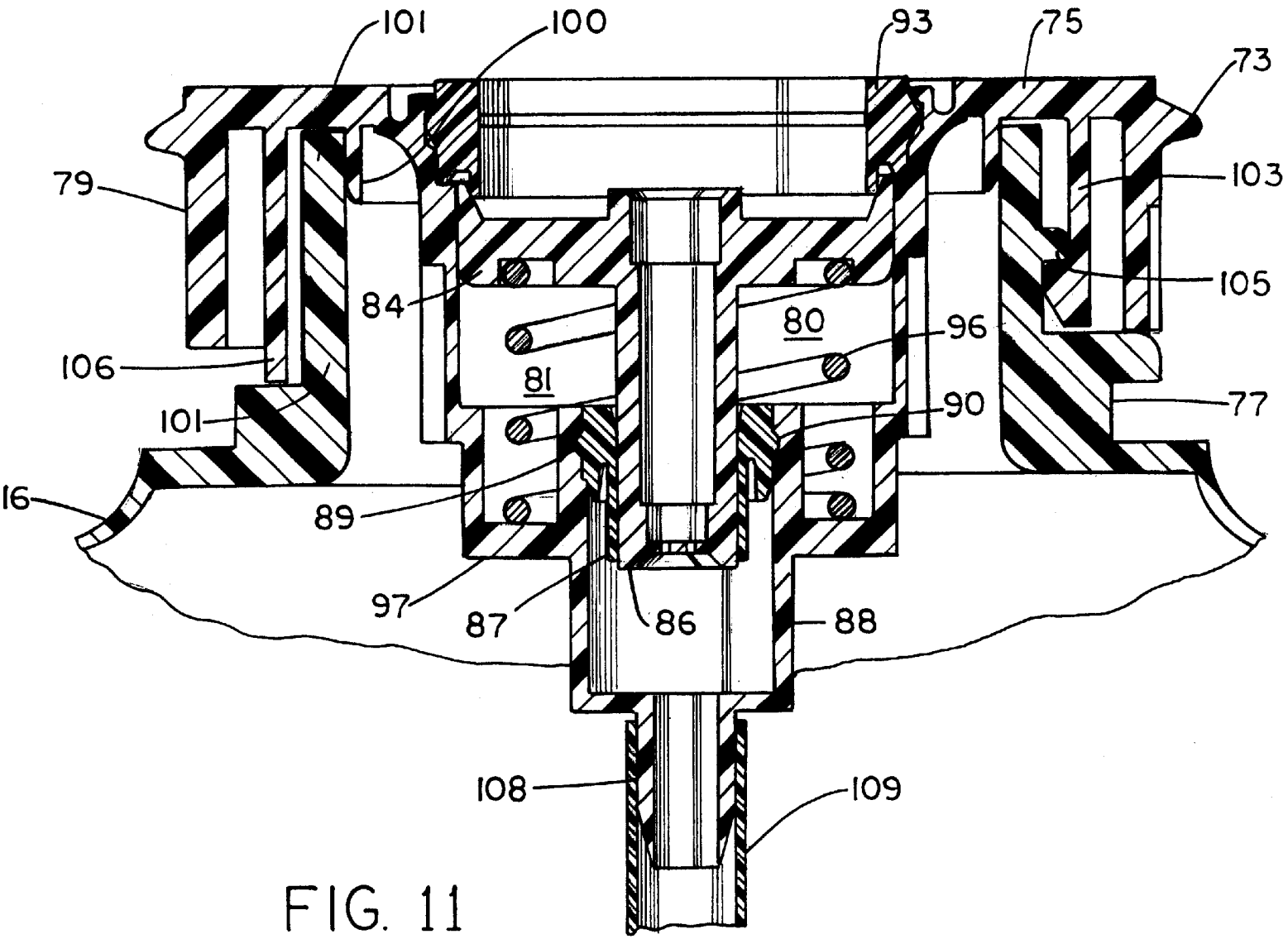
FIG. 11 is a view similar to FIG. 10 showing the plug on the container without engagement of the cap member.

As seen in FIG. 10 there is shown the cap member 40 engaged on the plug 75 on the container 16. FIG. 11 illustrates the plug 75 without engagement of the cap member 40. This plug 75 is the subject of commonly assigned patent application Ser. No. 09/368,986 filed Aug. 15, 1999 which teachings are fully incorporated herein by reference. As described in application Ser. No. 09/368,986, plug 75 is positioned on container 16 which includes a neck 77. The plug 75 includes an end wall 78 and a side wall 79. A core section 80 is provided defining a chamber 81 in the plug 75 and receives a valve assembly generally 83 having a valve member 84 with a tubular potion 86 having lateral passages 85. A valve sleeve 87 is retained in a collar section 88 by the undercut 89 and sealing bead 90. Valve member 87 is retained in the core section 80 by a valve retainer 93 which is connected to the plug 75 by the sealing bead 94 and the undercut 95 in the plug 75. A spring 96 rests on base 97 of the plug 75 and is biased against the valve member 84. A sealing flap 100 extends from end wall 78 to engage a side of band wall 101 to provide a seal between the plug 75 and the bottleneck 77.

A plurality of flexible fingers 103 extend from the under side of the plug 75 and have flange sections 104 for engagement with the rib 105 on the neck 77 of the bottle. There is also a guide projection 106 for orientation purposes. A nozzle 108 extends from collar section 88 for connection with pick up tube 109.

Referring to FIG. 10, cap member 40 includes a plunger member 60 provided by annular section 61 and head member 63, which are connected by the undercut 58 and the sealing bead 59. An O-ring is shown at 64 and an orifice 65 is provided through the head member 63. A check valve 71 is disposed in cap member 40 and has the ball 67 biased against valve seat 66 as well as valve seat member 69 by the spring 70. An orifice 68 extends through the valve seat member 69. Cap member 40 is retained on bottle 16 by the threads 72 engaging the threads 73 on the plug 75. A sealing gasket 41 is placed between the cap member 41 and the plug 75.

OPERATION

A better understanding of the portable sprayer devise 10 will be had by a description of its operation.

Cap member 40 is threadably placed on plug 75, which causes plunger member 60 to depress valve member 84 as shown in FIG. 10. This moves the passages 85 in tubular portion 86 out of sealing contact with valve sleeve 87 and provides a flow path of the cleaning concentrate from pick up tube 109, though passages 85 of tubular portion 92, orifices 65 and 68 to tubular connection 44 and ultimately to tube 42, as seen in FIG. 1. At the same time a venting of the container 16 is afforded by an opening (not shown) in the base 97 of the plug 75 and a flow path extending around the valve member 84 and between valve member 84 and valve retainer 93.

A source of pressurized water such as from a hose is connected to hose connector 28. A chemical concentrate such as a cleaner, a sanitizer, a degreaser, insecticide, or any other chemical concentrate contained in the container 16. Valve portion 27 of valve member 26 is placed in the "ON" position, which allows water to flow through the eductor 24 to siphon the chemical concentrate from container 16 into the water and mix therewith. The mixed solution is then sprayed through hose 50 and nozzle 53.

An important feature of the portable sprayer device 10 is the frame member 12 with the protective bottom portion 14. As this is a portable device and will be carried about while spraying, it is exposed to various objects such as walls, furniture, machines, doorways, etc. The frame member 12 with the bottom portion 14 and the side portions 18 and 19 protect the container 16 from undesired contact and possible breakage. Further, the bottom portion 14 protects the bottom of the container 16 from sudden impact, should the sprayer device be inadvertently dropped or placed on a surface in a forceful manner.

It will thus be seen that there is now provided a portable sprayer device wherein the container of chemical concentrate is protected from damage. The sprayer device has been illustrated without a guard for the eductor 24. If desired one can be provided and supported on the support flange 22. Also, while the bottom portion 14 has been shown to have a particular height, this can be varied with as small of height as possible for reduced weight purposes yet of sufficient height to provide protection for the container 16. The plug described above may also be of a different type which is the subject of commonly assigned U.S. Pat. No. 5,862,948 issued Jan. 26, 1999 which teachings are fully incorporated herein by reference. All such and other modifications within the spirit of the invention are meant to be within its scope as defined by the appended claims.

What is claimed is:

1. A portable sprayer device comprising:

a frame member having top, side and bottom portions, the bottom portion defined by a floor member and a side protective portion, the floor member and side protective portion constructed and arranged to receive a container on an inside of the side protective portion;

a fluid control valve having a fluid inlet connected to the top portion, the side portions supporting the fluid control valve therebetween above the container;

an eductor connected to a side portion, the eductor and fluid control valve in fluid communication;

a fluid intake line in fluid communication with the eductor and a container cap member; and a hose member in fluid communication with the eductor.

2. The portable sprayer device as defined in claim 1, wherein the side protective portion is provided by continuous, uninterrupted wall.

3. The portable sprayer device as defined in claim 2, wherein the floor member is provided by a strap.

4. The portable device as defined in claim 1, further including a fluid container positioned in the bottom portion and inside the protective portion, the container supported by the floor member.

5. The portable sprayer device as defined in claim 4, wherein the container is connected to the cap member.

6. The portable sprayer device as defined in claim 5, wherein the container has a spill proof plug.

7. The portable sprayer device as defined in claim 6, wherein the cap member includes a plunger portion for activating the spill proof plug.

8. The portable sprayer device as defined in claim 1, wherein the eductor is back pressure tolerant.

9. The portable spray device as defined in claim 1, further including a filter and a filter chamber connected to the eductor.

* * * * *